US005685046A

United States Patent [19]

Neag et al.

[11] Patent Number: 5,685,046

[45] Date of Patent: Nov. 11, 1997

[54] MOTOR VEHICLE DOUBLE PIVOT HINGE

[75] Inventors: Dorinel Neag, Commerce Township; Richard Hulbert, West Bloomfield; James N. Owens, II, Wayne, all of Mich.

[73] Assignee: Chrysler Corporation, Auburn Hills, Mich.

[21] Appl. No.: 631,483

[22] Filed: Apr. 12, 1996

[51] Int. Cl.[6] ..... E05D 3/06

[52] U.S. Cl. ..... 16/366; 16/334

[58] Field of Search ..... 16/366, 334, 329, 16/330, 331, 232, 344, 348, 371, 303, 312, 341

[56] References Cited

U.S. PATENT DOCUMENTS

| | | | |
|---|---|---|---|
| 1,065,406 | 6/1913 | Swinford . | |
| 1,735,696 | 11/1929 | Ridley . | |
| 2,372,431 | 3/1945 | Kahle . | |
| 2,870,477 | 1/1959 | Anthony et al. . | |
| 3,619,853 | 11/1971 | Merrill . | |
| 4,641,881 | 2/1987 | Nomura et al. . | |
| 4,655,499 | 4/1987 | Piper . | |
| 4,719,665 | 1/1988 | Bell . | |
| 4,772,054 | 9/1988 | Schreiber et al. . | |
| 4,928,350 | 5/1990 | Morgan . | |
| 5,054,165 | 10/1991 | Marchione . | |
| 5,561,887 | 10/1996 | Neeag et al. | 16/334 |

FOREIGN PATENT DOCUMENTS

| | | |
|---|---|---|
| 30 23 637 | 1/1981 | Germany . |

*Primary Examiner*—Chuck Y. Mah

*Attorney, Agent, or Firm*—Thomas G. Pasternak

[57] ABSTRACT

A double pivot hinge for rotatably mounting a door to a vehicle body for sequential movement between closed, mid open, and full open positions in an uninterrupted manner. The hinge assembly includes a U-shaped link having a bight portion joining first and second legs with body and door hinge leafs each pivoted by a pin to respective first and second legs. A cam plate is fixed on each leaf, with each plate defining an arcuate cam edge having its center on its associated pin axis. A locking bar, supporting a cam follower at one end and a lug follower at an opposite end, is pivoted adjacent its midpoint to one edge of the bight portion. Rotation of the door about the first pin, from the closed position to the mid open position, causes the lug follower to move on the body leaf cam edge to a cam-free terminus, in opposed relation to a notch in its associated cam edge. Upon initial rotation of the door about the second pin to its full open position, the cam follower is moved out of a recess in the door leaf cam edge, thereby pivoting the bar so as to move the lug follower into its notch, positively locking the link to the fixed body leaf until the door is returned to its mid open position. Just prior to the door being returned to its mid open position, the cam follower is moved on its cam edge into its recess, causing the bar to rotate the lug follower out of its notch, thereby permitting the link and the door leaf to conjointly pivot about the first pin to the door closed position.

14 Claims, 4 Drawing Sheets

MOTOR VEHICLE DOUBLE PIVOT HINGE

FIELD OF THE INVENTION

This invention relates to double pivot door hinges and, more particularly, to a positive locking arrangement for a double pivot hinge providing sequential movement of a vehicle door between closed, mid open, and full open positions in an uninterrupted manner.

BACKGROUND OF THE INVENTION

Double pivot hinge arrangements for vehicle doors operative to rotate the doors to a plurality of hold-open positions are known. An example of one such double pivot hinge arrangement is disclosed in the U.S. patent application Ser. No. 08/438,115, filed May 8, 1995 for Neag et al., entitled "Vehicle Double Pivot Door Hinge Arrangement", and assigned to the assignee of this invention. In the Neag et al. double pivot hinge, a unique resilient detent and raceway arrangement enables an operator to move a vehicle door by one hand between closed, mid hold open, and full hold open positions. The hinge includes a U-shaped hinge link, having a bight portion joining first and second legs, wherein a first pin connects a body hinge leaf to an end of the first leg and a second pin connects a door hinge leaf to an end of the second leg. Each body and door hinge leaf includes a raceway formed with a detent pocket, while each leg has a spring-loaded detent member adapted for biased travel along a raceway arcuate path, providing frictional resistance capture and release by an associated pocket during the door sequential rotation. It will be noted that a disadvantage of such a frictional resistance door hold-open arrangement is that if the door is improperly rotated the latching sequence may be by-passed, thereby subjecting the hinge to excessive stress and possible damage.

SUMMARY OF THE INVENTION

The present invention provides a double pivot hinge for moving a vehicle door between closed, mid open, and full open positions, wherein a U-shaped link has a bight portion joining first and second legs, with body and door hinge leafs each pivoted by a pin to a respective first and second leg. The hinge features a cam plate, fixed on each leaf, defining an arcuate cam edge having its center on its associated pin axis, and a single locking bar, supporting a cam follower on one end and a lug follower on an opposite end, pivoted adjacent its midpoint to one edge of the bight portion, wherein the bar followers cooperate with their associated cam plates to provide a positive locking arrangement for the sequential movement of the door between its closed, mid open, and full open positions.

It is yet another feature of the present invention wherein, with the door in its closed position, the bar is pivoted in a first direction locating the lug follower on the body leaf cam edge at a first terminus. Rotation of the door about the first pin, from the door closed position towards the door mid open position, causes the lug follower to move on the body leaf cam edge from its first terminus to a location juxtaposed a cam-free second terminus opposing a notch in its associated cam edge, whereby during the movement of the lug follower, the cam follower is captured in a first terminus radiused recess in the door leaf cam edge, thereby positively locking the door leaf from pivoting relative to the link.

It is a further feature of the present invention wherein with the door rotated to its mid open position such that the lug follower is located at its second cam-free terminus, that initial rotation of the door about the second pin towards its full open position causes the cam follower to move out of its first terminus recess in the door leaf cam edge, thereby pivoting the bar in a second direction so as to move the lug follower into its opposed notch, thereby positively locking the link to the body leaf.

It is still another feature of the present invention wherein during completion of the door rotation to its full open position, the cam follower moves on its cam edge to its second terminus, and wherein return of the door towards its mid open position results in the cam follower moving from its second terminus to a position juxtaposed its first terminus recess, such that during the cam follower movement on its cam edge the lug follower positively locks the link to the body leaf.

It is a still further feature of the present invention wherein, upon the door being rotated to its mid open position returning the cam follower to its first terminus recess, the bar is pivoted in its first direction moving the lug follower out of its notch to its second cam-free terminus, wherein the link and the door leaf are free to pivot as a unit about the first pin rotating the door to the closed position.

These and other features and advantages of the invention will be more fully understood from the following detailed description of the invention taken together with the accompanying drawings.

DETAILED DESCRIPTION OF THE INVENTION

Figure 1:
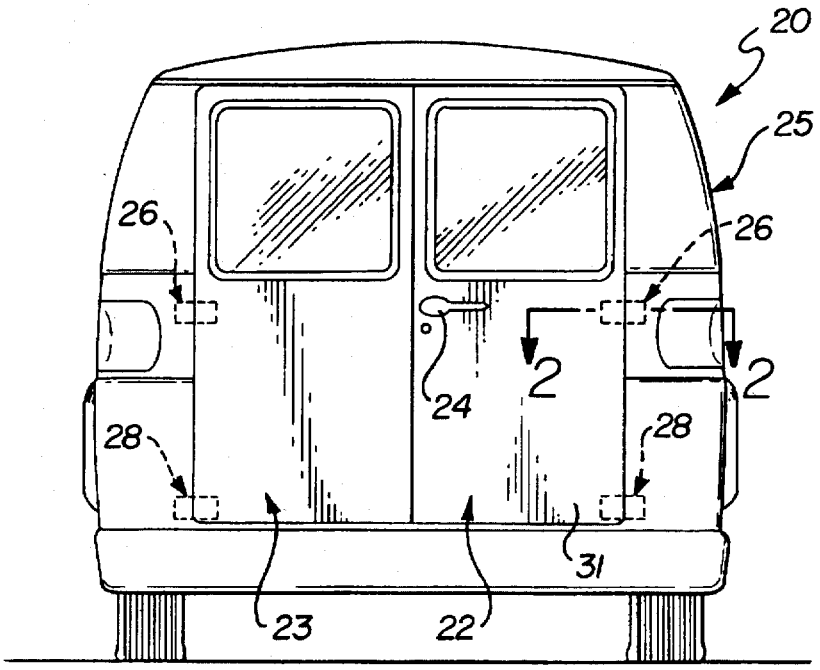
FIG. 1 is a rear view of a van type vehicle having a pair of rear doors mounted thereon by double pivot hinges in accordance with the present invention.

Referring now to the drawings in detail, FIG. 1 illustrates a van type automotive vehicle 20 with right hand 22 and left hand 23 closed rear access doors. The right hand door 22 overlaps the left hand door 23 and is releasably latched thereto by a conventional latch mechanism, operated by a latch handle 24, when the doors are closed. Each door is mounted to vehicle body 25 by upper 26 and lower 28 double pivot hinges. As the hinges are the same, only the right hand upper hinge assembly 26 will be described.

Figure 2:
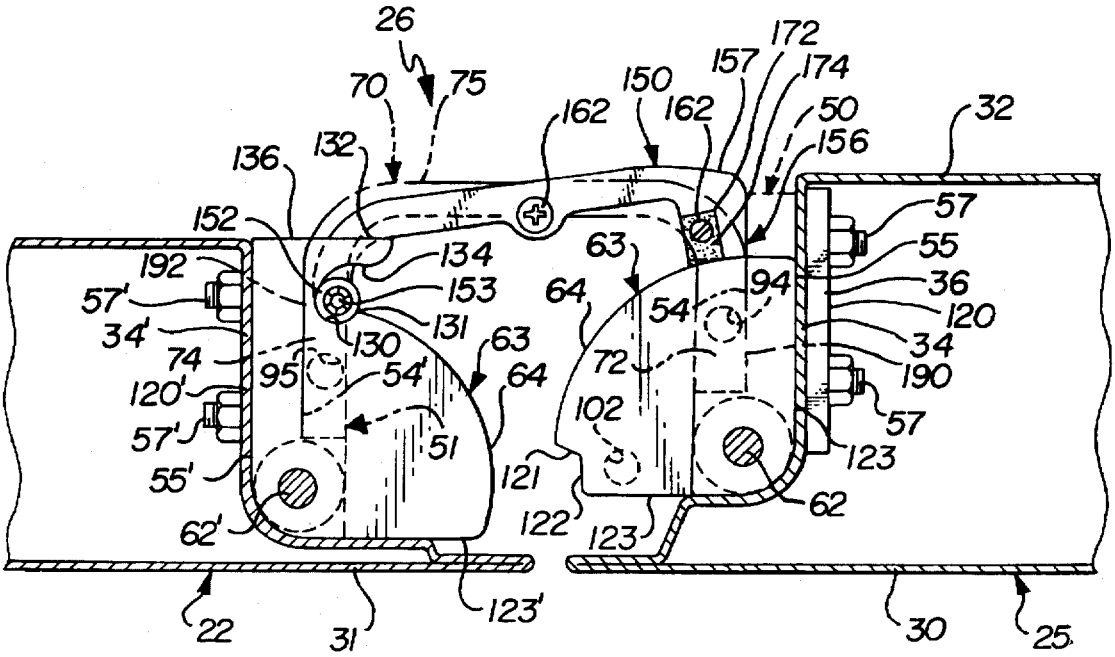
FIG. 2 is a fragmentary horizontal sectional view, taken on the line 2—2 of FIG. 1, showing the upper right side double pivot hinge in the door closed position.

FIG. 2 shows the upper right hand hinge 26 recessed from an exterior rear body panel 30 and exterior door panel 31 of the right hand door 22, with the panels 30 and 31 in flush relation. An inner rear body panel 32 is shown joined to a D-pillar wall 34 of the door opening, with the interior surface of the D-pillar wall reinforced by a backing plate 36.

Figure 7:
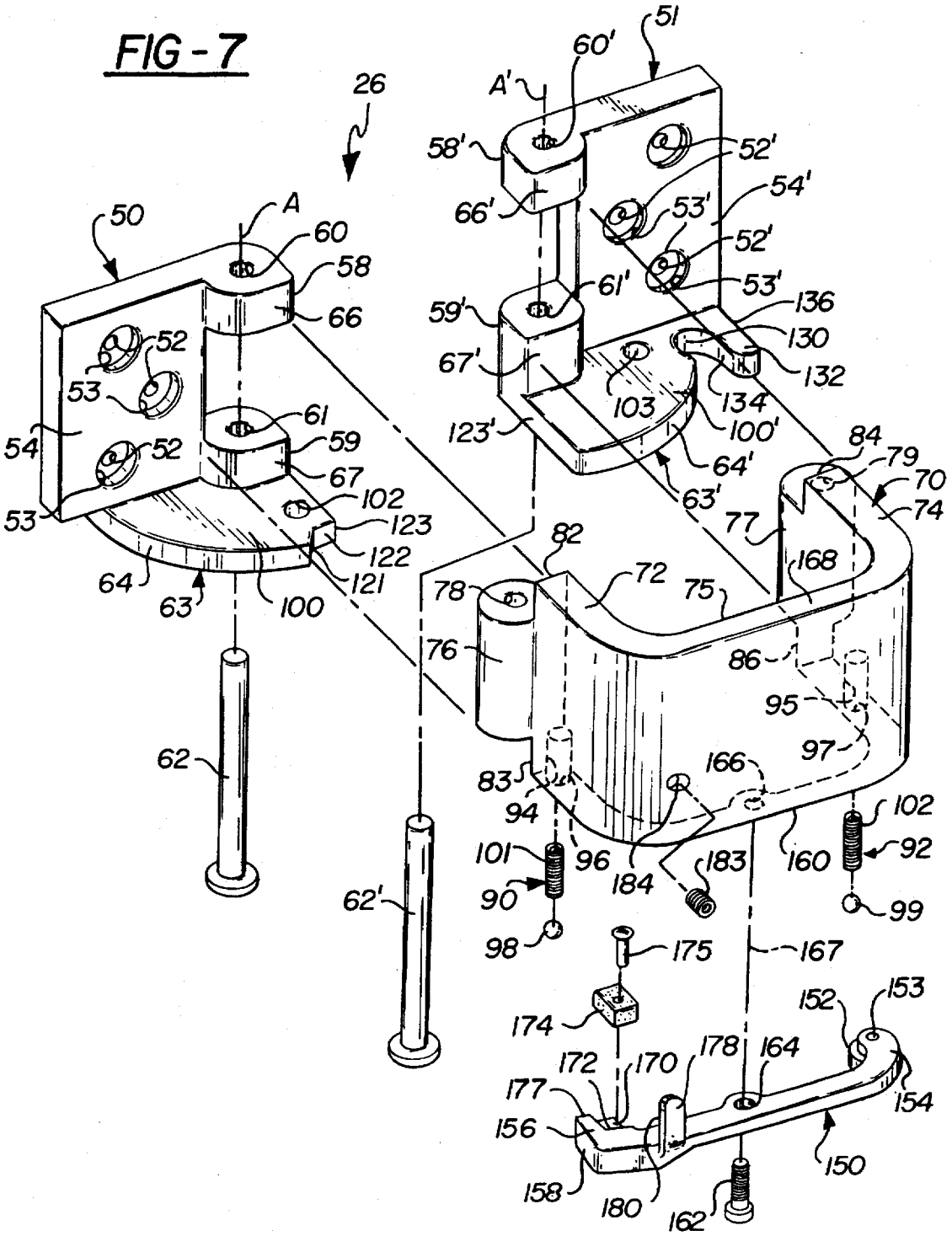
FIG. 7 is an exploded detail perspective view of the double pivot hinge.

With reference to FIG. 7, the hinge 26 includes a body leaf 50 and a door leaf 51. As the body 50 and door 51 leafs are similar, the same reference numerals are used in the following description to identify the same or similar elements, with the exception that the reference numerals for the door leaf 51 are primed.

The body leaf 50 is shown in FIG. 7 having three bolt holes 52 with each hole countersunk at 53 in hinge leaf outer face 54. It will be noted in FIG. 2 that opposite face 55 of body leaf 50 is secured by through bolts 57 to an opposed surface of the D-pillar wall 34. As seen in FIG. 7, the body leaf 50 includes upper 58 and lower 59 apertured ears, with upper ear bore 60 and lower ear bore 61, aligned on a first pivot axis "A", for receiving a first hinge pin 62. The door leaf 51 has its inner face 55' secured to an opposed surface of door shut-face wall 34' by through bolts 57'.

As viewed in FIG. 7, horizontally disposed cam plates 63 and 63' are shown secured, as by welding, to an underside of an associated body leaf 50 and door leaf 51. Each cam plate 63, 63' defines a substantially ninety degree arcuate cam edge 64, 64' respectively, with each cam edge center of curvature aligned on its associated hinge pin axis A, and A'. It will be noted that each leaf upper ear 58, 58' is formed with an associated upper blocking surface 66, 66' which upper surfaces are co-planar with a blocking surface 67, 67' of its associated lower ear 59, 59'. The upper 66, 66' and lower 67, 67' paired blocking surfaces are located in common vertical planes disposed in off-set parallel relation to their associated leaf faces 54, 54'.

The hinge 26 further includes a generally U-shaped link 70 formed with first 72 and second 74 parallel legs joined by a connecting bight portion 75. The first leg free end is formed with an apertured single ear 76, adapted for insertion between its associated body leaf upper 58 and lower 59 ears, while the second leg free end is formed with an apertured single leg ear 77 adapted for insertion between its associated door leaf upper 58' and lower 59' ears. The first and second leg ears 76, 77 are adapted for insertion between associated body and door leaf pair of ears 58, 59 and 58', 59' respectively, wherein the link ear bores 78 and 79 are coaxially aligned with their associated leaf ear bores 60, 61 and 60', 61'.

Figure 3:
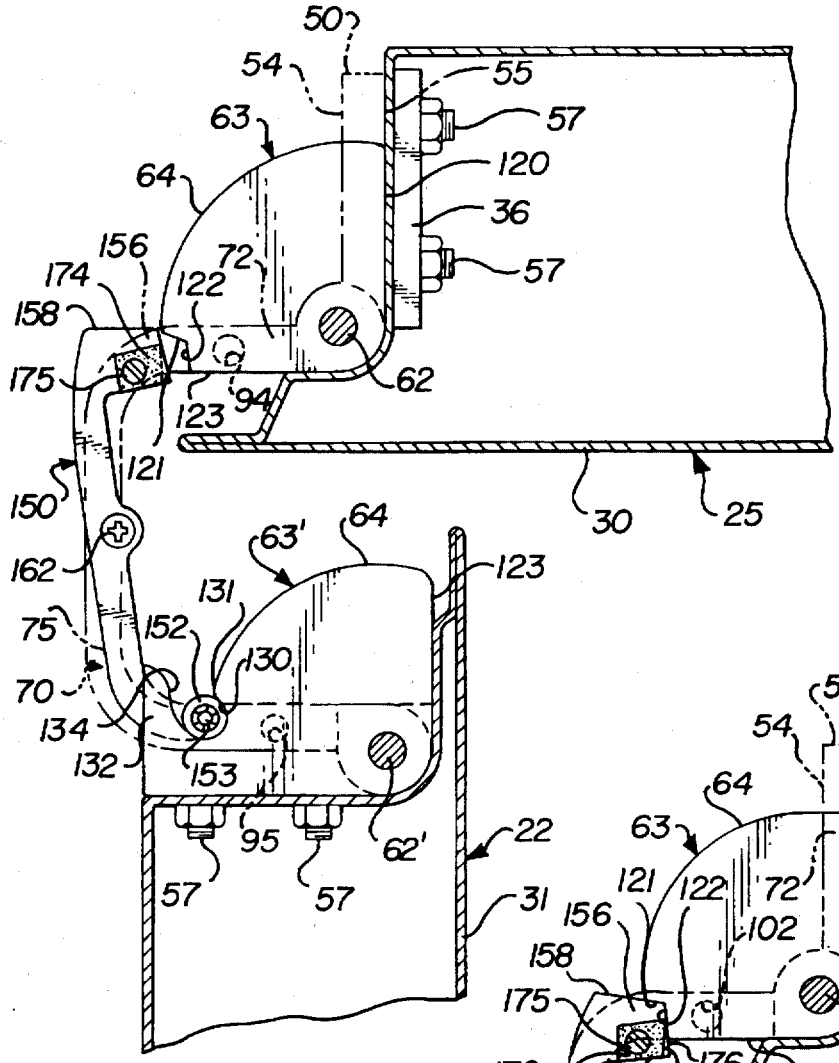
FIG. 3 is a view similar to FIG. 2 showing the hinge in the door mid open position.

Referring to FIG. 7, the free end of first leg 72 defines upper 80 and lower 82 stop faces adapted to contact or abut with their associated body leaf upper 66 and lower 67 ear blocking surfaces, upon the link 70 and the door leaf 51 being rotated about the first pin 62 to the door mid hold-open position of FIG.3. In a corresponding manner, leg 74 free end upper 84 and lower 86 stop faces are adapted to contact associated upper 66' and lower 67' ear blocking surfaces upon the door leaf 51 being rotated to the door full hold-open position of FIG. 5.

In FIG. 7 it will be noted that numerals 90 and 92 each generally indicate first leg 72 and second leg 74 resilient detent member latching devices. Each first 72 and second 74 leg has an associated first 94 and second 95 vertical blind bore therein. Open lower end 96 of the first bore 94 is located in bottom edge of leg 72, while open lower end 97 of the second bore is located in bottom edge of leg 74. Each blind bore open end 96, 97, located a predetermined dimension from its associated leg free end, is adapted to receive a resilient detent member in the form of a lower spring-loaded latching ball 98, 99, respectively.

The latching balls 98 and 99 are each biased downwardly into rolling or sliding contact with an opposed upper raceway surface 100, 100' of its associated cam plate 63, 63' by coil springs 101, 102 telescoped within an associated blind bore 94, 95. Each ball 98, 99 is spring biased to releasably seat in an associated semi-spherical or half-round detent pocket 102, 103 formed in respective raceway surfaces 100, 100'. The ball 98 is biased to seat in pocket 102, after travel along a raceway concentric path, upon the door being rotated to its FIG. 3 mid hold open position. In a like manner, the ball is biased by spring 102 to seat in detent pocket 102', after travel along a raceway concentric path, upon the door being rotated to the FIG. 5 full hold open position.

Referring to FIG. 2, the body leaf cam edge 64 has a first terminus, adjacent its juncture with cam plate first radial edge 120, disposed parallel to leaf 50. The cam edge 64 ends in a obtuse angled notch, defined by angled edge 121 and an intersecting arcuate base 122, concentric about pin axis A, wherein the obtuse angle is of the order of 100 degrees. The notch is positioned adjacent second radial plate edge 123, with the edge 123 disposed normal to the body leaf 50. The door leaf cam edge 64' has a substantially half-round radiused first recess terminus 130, starting at lead-in juncture 131, and a second terminus adjacent the juncture of cam edge 64' with cam plate radial edge 123', with the edge 123' disposed normal to door leaf 51.

In the disclosed embodiment, the cam edge 64' first recess terminus 130 is partially closed by a cam plate prong portion 132 extending normally from the door leaf first radial edge 120'. The prong portion 132 has a interior reverse curved section 134, forming an extension of the recess 130 opposite its lead-in juncture 131, for a purpose to be explained below. It will be noted that prong portion 132 is defined by door leaf cam plate edge 136, disposed in parallel opposite relation to the door leaf cam plate first radial edge 123'.

With reference to FIG. 7, numeral 150 generally indicates a locking bar which underlies, in a substantially coextensive manner, the link bight portion 75. The bar 150 supports an anti-friction roller wheel cam follower 152 on a lower end of a vertically disposed wheel shaft 153 secured to one laterally projecting hook-shaped end 154 of the bar. A tooth-shaped lug follower 156, formed on an opposite end of the bar 150, projects laterally from the bar in the same outward direction as the hook-shaped end 154. Inner 157 and outer 158 converging flank surfaces partially define the follower lug 156. The bar 150, pivoted adjacent its midpoint to one underlying lower edge 160 of bight portion 75 by a screw fastener 162, extends through a bar central aperture 164, for securement in lower edge threaded bore 166. The fastener 162 supports the bar 150 for pivotal movement about the fastener vertical axis 167, located intermediate legs 72 and 74 of the link 70.

It will be appreciated that while the locking bar 150 is shown pivoted on the link lower edge 160 to conceal the bar from view, the invention contemplates alternate hinge designs wherein the bar 150 may be pivoted on upper edge 168 of bight portion 75. In such a design, each cam plate 63 and 63' would, of course, be located on the upper end of its associated body 50 and door 51 leaf.

Figure 4:
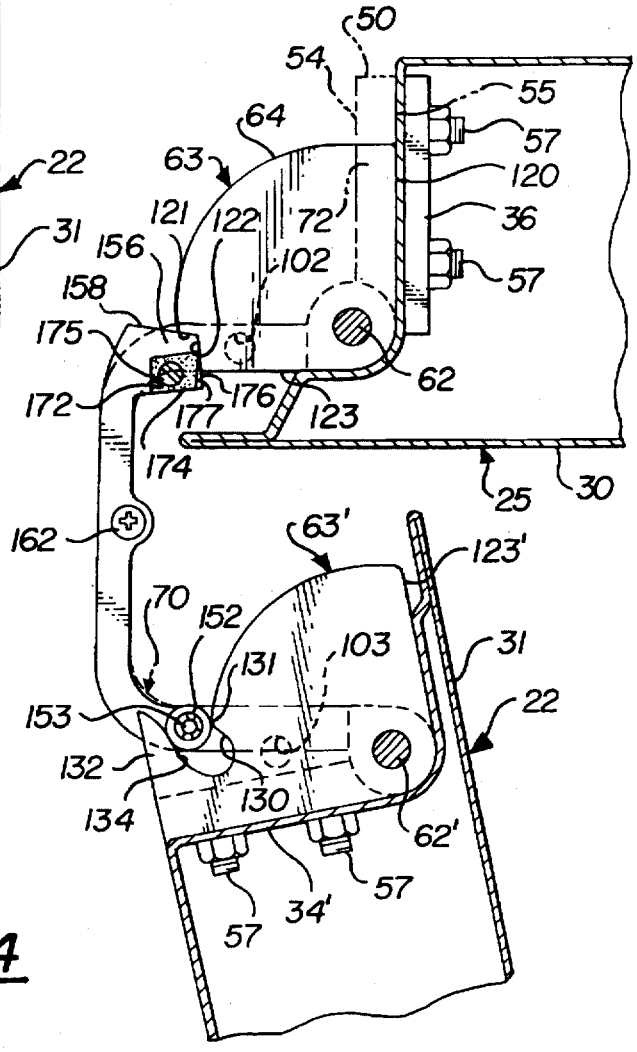
FIG. 4 is a view similar to FIG. 2 showing the hinge with the door slightly rotated a few degrees beyond its mid open position.

Referring to FIG. 7, the bar lug follower 156 includes an insert holder pocket 170, defined by a right-angled internal corner 172, sized for reception of a generally rectangular-shaped bearing insert 174 of suitable material, such as plastic. As seen in FIG. 4, the insert 174, retained in the pocket by threaded fastener 175, has a concave arcuate bearing edge 176, projecting outwardly from lug face 177, adapted to slidably contact an opposed convex arcuate base 122 of the cam plate notch.

Figure 6:
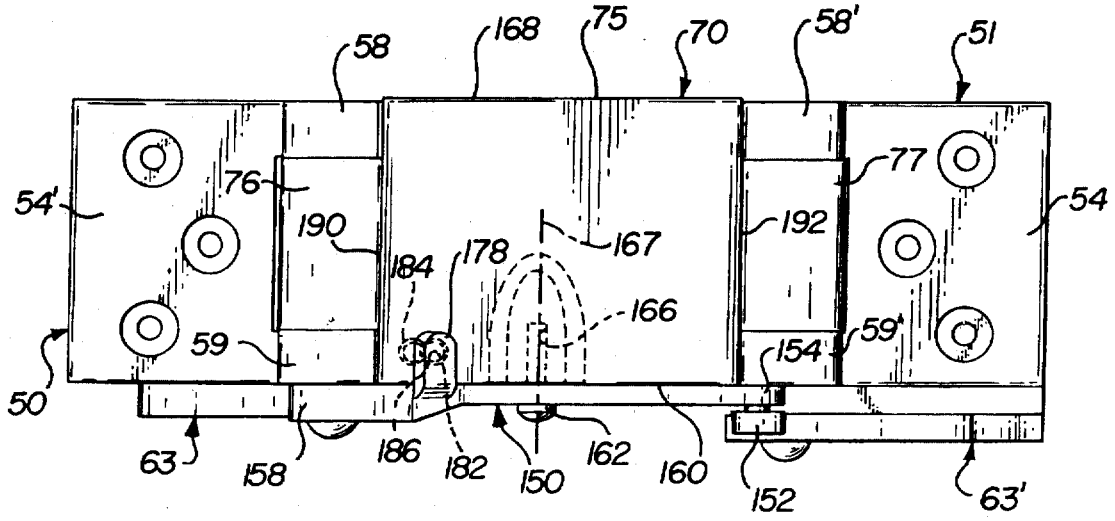
FIG. 6 is a detail side view of the hinge in its full-open position of FIG. 5.

As viewed in FIGS. 6 and 7, the locking bar 150 includes an upstanding arm 178, secured adjacent lug follower 156, having an inner surface 180 formed with a blind socket 182 for receiving one end of a coil biasing spring 183. A blind bore 184, provided in an exterior surface of the bight portion 75, located in opposed coaxial alignment with the arm blind socket 182, receives an opposite end of the spring 183. The spring 183, which biases the cam follower 152 into its recess 130 and cam edge 64', obviates noise conditions between the locking bar and the hinge.

To maintain reliable operation of the hinge, for example in the event of failure of the biasing spring 183, the prong portion curved sector 134 insures that the cam follower 152 will travel freely between the edge cam 64' and the recess 130, in response to pivotal movement of the locking bar 150 about its axis 167.

Turning now to the operation of the double pivot hinge 26 in a first mode without the inclusion of the resilient detent latching devices 90 and 92. With the door in its closed FIG. 2 position, exposed face 54 of the body leaf 50 contacts outer surface 190 of the link first leg, while the door leaf 51 exposed face 54' contacts outer surface 192 of the second leg 74. The locking bar 150 is shown pivoted in a first direction, such that its tooth follower 156 is located at its first terminus on cam edge 64 while cam follower 152 is seated in its first terminus recess 130.

Upon opening the door from the FIG. 2 closed position to the FIG. 3 mid open position, the link 70 and the door leaf 51 conjointly rotate substantially ninety degrees about the first pin 62, wherein the first leg upper 82 and lower 83 stop faces contact their associated body leaf upper 66 and lower 67 blocking surfaces. During rotation to the door mid position, lug follower 156 moves along its associated cam edge 64 from its first FIG. 2 terminus to its second FIG. 3 cam-free terminus, wherein lug follower 156 is positioned beyond the cam edge 64 in opposed spaced relation with notch 122.

If it is desired to rotate the door substantially 90 degrees from its mid hold open position to its full hold open position, the door is initially manually moved a few degrees toward the full open position, as seen in FIG. 4, wherein the cam follower 152 moves out of the radiused recess terminus 130, to a position at juncture 177, contacting the door leaf cam edge 63'. This cam follower initial travel pivots bar 150 about its axis 167, thereby moving the lug follower angled flank 158 into flush locked engagement with notch angled edge 121. As a result, the bar lug 156 positively interlocks link 70 with the body leaf 50, permitting the door and door leaf 51 to rotate in unison, relative to the interlocked link 70 and body leaf 50, about the second pivot pin 62', to the door full open position of FIG. 5. During this joint movement, the roller cam follower 152 moves along the door leaf cam edge 64' to its second terminus, shown in FIG. 5.

Figure 5:
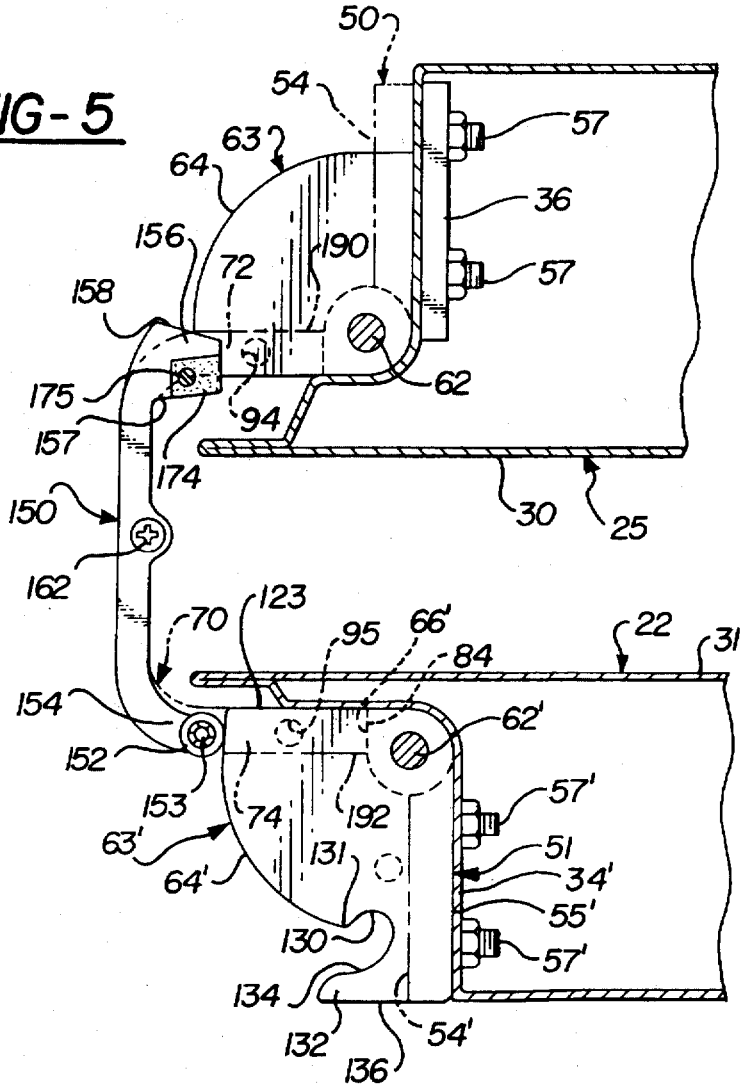
FIG. 5 is a view similar to FIG. 2 showing the hinge in the door full open position.

When the door is manually returned from the full open position toward the mid open position, the cam follower 152 moves on cam edge 64' from its second terminus to juncture 131, as seen in FIG. 5, juxtaposed its first recess terminus 130. As a result, the bar 150 pivots in its first direction, thereby withdrawing the lug follower 156 from the notch 122 to its second cam-free terminus of FIG. 3. Continued rotation of the door to its closed position, moves the lug follower 156 along its cam edge 64 to its first FIG. 2 terminus.

The following discussion concerns the operation of the double pivot hinge 26 resilient detent latching devices 90 and 92. The latching devices 90 and 92 may function with the double pivot hinge substantially as described in the above cited Neag et al. patent application, or in combination with the interlocking bar arrangement 150 of the present invention.

With reference to FIG. 2, the body leaf plate detent pocket 102 is not in latched engagement with its associated link spring-loaded ball 98, while the door leaf cam plate detent pocket 103 is in latched engagement with its associated link spring-loaded ball 99. Thus, upon the door 22 being unlatched by the body by handle 23, the door leaf 51 and the link 70 are adapted to be rotated in unison about body leaf pin 62 to a predetermined self-latching substantially ninety degree or mid hold-open position shown in FIG. 3. This results because the body leaf 50 is initially in its unlatched door closed position of FIG. 2, by virtue of its detent pocket 102 being located substantially 90 degrees from engagement by spring-loaded ball 98, while door leaf detent pocket 103 is latched to its associated spring loaded ball 99.

As the door 22 and link 70 are rotated by the operator to their FIG. 3 position, the link leg spring loaded ball 98 is rotated substantially 90 degrees on body hinge raceway 100 into self-latching hold open engagement with detent pocket 102. At the FIG. 3 door mid hold-open position, it will be noted that the door leaf detent pocket 103 remains in latched engagement with its associated spring-loaded ball 99. It will be further noted in FIG. 3, that upon the door 22 and link 70 being pivoted to their mid position about pin 62, the link stop faces 80 and 82 are rotated into contact with their associated body hinge upper and lower blocking surfaces 66 and 67 preventing further door opening rotation of the link 70 relative to the body leaf 50. Accordingly, the operator may continue rotating the door causing the door leaf detent pocket 103 to move the link spring-loaded ball 99 upwardly into its blind bore 95 in a self-unlatching manner allowing the door to be rotated about the pin 62' to the full hold-open position. It will be noted in FIG. 5, that the door leaf blocking surfaces 67' and 66' contact associated link stop faces 84 and 86, providing the door full hold-open position.

With reference to FIG. 5, the door 22 is shown rotated to its full hold-open position about pin 62' as the body leaf blocking surfaces 58 and 59 remain in contact with their associated link stop faces 82 and 83, thereby preventing door opening movement about pivot pin 62. The door is positively blocked against further opening rotation because door hinge blocking surfaces 66' and 67' contact their associated stop faces 84 and 86.

Upon rotating the door from its full open position of FIG. 5 to its mid open position of FIG. 3 about pin 62', the door leaf detent pocket 103 is pivoted into engagement with ball 99, while door leaf 51 is moved into contact with its associated leg 74. During rotation of the door from the full open FIG. 5 position to the mid open FIG. 3 position, the body leaf pocket 102 remains latched with its associated ball 98.

Upon swinging the door leaf 51 in unison with the link 70, about pin 62 from its FIG. 3 mid hold-open position to its FIG. 2 door closed position, ball 98 is moved upwardly into its blind bore 94 by its associated detent pocket 102 in a self-unlatching manner. It will be observed that the spring-loaded ball 98 is disengaged from body leaf pocket 102 because hinge leaf 51 is in contact with its associated leg 74, whereby the door, the door leaf 51, and the link 70 are all pivoted in unison about the pin 62.

Although the invention has been described by reference to a specific embodiment, it should understood that numerous changes may be made within the spirit and scope of the inventive concepts described. Accordingly, it is intended that the invention not be limited to the described embodiment, but that it have the full scope defined by the language of the following claims.

What is claimed is:

1. A double pivot hinge rotatably mounting a door on a vehicle body for movement between closed, mid open, and full open positions, said hinge comprising;

a U-shaped link with a bight portion joining first and second legs, a first pin pivoting a body leaf to an end of said first leg and a second pin pivoting a door leaf to an end of said second leg, each said body and door leaf having a plate thereon defining an arcuate cam edge concentric with an associated pin axis, a locking bar having a cam follower at one end and a lug follower at an opposite end and being pivoted adjacent its midpoint relative of said bight portion, wherein with the door in the closed position said bar head pivoted in a first direction such that said lug follower contacts said body plate cam edge at a first terminus and said cam follower is captured in a first terminus radiused recess in said door plate cam edge;

whereby rotation of the door in an opening direction to the mid open position moves said lug follower along said body leaf cam edge to a second cam-free terminus, opposed to a notch in its body leaf cam edge, wherein a first leg stop connected to said first leg contacts a body leaf surface; further rotation of the door towards its full open position moves said cam follower out of said recess onto said door leaf cam edge, thereby pivoting said bar in a second direction and moving said lug follower into positive engagement with said notch and locking said link to said body leaf, and continued rotation of the door to the full open position permits rotation of the door leaf relative to said link about said second pin axis, while said cam follower moves on said door leaf cam edge to a second terminus; and whereby rotating the door in a closing direction to its mid open position pivots said bar in said first direction, returning said cam follower to said recess, thereby moving said lug follower out of said notch in its second cam-free terminus, and further rotation of the door to the closed position moves said lug follower on its cam edge to its first terminus.

2. The double pivot hinge as set forth in claim 1 wherein said locking bar is pivoted on a lower edge of said link bight portion, and each said plate is secured to a lower edge of its associated body and door leaf.

3. The double pivot hinge as set forth in claim 1 wherein spring means operative between said bar and said link biases said cam follower into contact with said door leaf cam edge and said radiused recess.

4. The double pivot hinge as set forth in claim 3 wherein said recess is partially closed by a door leaf plate prong portion projecting normal to said door leaf, said prong member defining a curved sector forming a continuation of said radiused recess, said curved sector being operative with said recess to insure rotation of said bar in said first and second directions during rotation of the door between its mid open and full open positions in the event of failure of said biasing spring means.

5. The double pivot hinge as set forth in claim 3 wherein said spring means comprises an arm on said locking bar adjacent its lug follower end, said arm having an inner surface formed with a blind socket positioned in opposed coaxial relation with a blind bore in an opposed exterior surface of said link bight portion, said blind socket and said bight portion blind bore receiving therein opposite ends of a compression coil spring, said spring being operative to urge rotation of said bar in a first direction thereby biasing said cam follower toward its associated cam edge and first terminus recess.

6. The double pivot hinge as set forth in claim 1 wherein said lug follower comprises an insert pocket removably holding a bearing insert therein, said insert having an arcuate bearing edge adapted to engage and slide, in a conforming manner, on said body leaf arcuate cam edge.

7. The double pivot hinge as set forth in claim 6 wherein said insert is formed of plastic material.

8. The double pivot hinge as set forth in claim 4 wherein said body leaf cam edge notch is defined by an arcuate notch base and an angled edge intersecting said base at an internal obtuse angle conforming to an external obtuse angle formed by the intersection of an outer flank and a front face of said locking bar lug.

9. The double pivot hinge as set forth in claim 8 wherein said obtuse angle is of the order of 100 degrees.

10. The double pivot hinge as set forth in claim 1 wherein said door leaf plate radiused recess is substantially semicircular in configuration.

11. The double pivot hinge as set forth in claim 1 wherein said cam follower comprises a roller cam follower.

12. The double pivot hinge as set forth in claim 1 wherein at least one of said link legs has resilient detent means protruding therefrom for biased contact with an opposed horizontal surface raceway of an associated cam plate raceway, said raceway having a detent pocket adapted to cooperate with an associated resilient detent member in either a self-latching or self-unlatching manner upon predetermined relative rotation between said link and an associated cam plate.

13. The double pivot hinge as set forth in claim 1 wherein each said body and door leaf includes a horizontally disposed surface defining an arcuate raceway formed with a detent pocket, each said link leg having a resilient detent member engaging an associated one of said raceways and adapted for biased travel there along each said detent member cooperating with an associated one of said detent pockets in either a self-latching or self-unlatching manner upon predetermined door rotation; whereby upon the door being rotated from a closed position to a mid open position each leaf detent pocket is adapted to cooperate with an associated resilient detent member in a self-latching manner.

14. The double pivot hinge as set forth in claim 13 wherein said body leaf detent pocket is adapted to cooperate with an associated resilient detent member in a self-latching manner; whereby upon the door being rotated from its mid open position to its full open position said door leaf detent pocket is moved from its latched mode with its associated detent member to an un-latched mode.

* * * * *